United States Patent [19]

Wilson et al.

[11] 4,446,796

[45] May 8, 1984

[54] TABLE AND IMPROVED HINGE MECHANISM

[75] Inventors: Kermit H. Wilson, Edina; Ronald R. Carlson, Excelsior, both of Minn.

[73] Assignee: Sico Incorporated, Minneapolis, Minn.

[21] Appl. No.: 161,750

[22] PCT Filed: May 16, 1980

[86] PCT No.: PCT/US80/00568

§ 371 Date: Jun. 23, 1980

§ 102(e) Date: Jun. 23, 1980

[87] PCT Pub. No.: WO81/03269

PCT Pub. Date: Nov. 26, 1981

[51] Int. Cl.[3] ..... A47B 1/04

[52] U.S. Cl. ..... 108/69; 108/77; 16/357

[58] Field of Search ..... 108/77, 78, 69, 112; 16/348, 361, 364, 357; 248/345.1

[56] References Cited

U.S. PATENT DOCUMENTS

| | | | |
|---|---|---|---|
| 131,696 | 9/1872 | Mathewson . | |
| 158,063 | 12/1874 | Grimm | 16/364 |
| 1,869,001 | 7/1932 | Allen | 108/78 |
| 1,999,705 | 4/1935 | Sintz . | |
| 2,167,489 | 7/1939 | Renga | 16/357 |
| 2,358,174 | 9/1944 | McFall . | |
| 2,685,147 | 8/1954 | Burr | 248/345.1 |
| 2,714,743 | 8/1955 | Lochner | 16/364 |
| 2,820,242 | 1/1958 | Erickson . | |
| 2,844,257 | 7/1958 | Friedman . | |
| 2,911,217 | 11/1959 | Hirsch et al. . | |
| 3,063,088 | 11/1962 | Blair et al. | 16/348 |
| 3,095,833 | 7/1963 | Peter . | |
| 3,103,422 | 9/1963 | Green | 248/345.1 |
| 3,177,824 | 4/1965 | Onishi . | |
| 3,305,204 | 2/1967 | Babin . | |
| 3,437,058 | 4/1969 | Bue . | |
| 3,541,566 | 11/1970 | Riebsamen . | |
| 3,672,312 | 6/1972 | Pettit et al. . | |
| 4,068,601 | 1/1978 | Marsh et al. . | |

*Primary Examiner*—Francis K. Zugel

*Attorney, Agent, or Firm*—Merchant, Gould, Smith, Edell, Welter & Schmidt

[57] ABSTRACT

A table and improved hinge mechanism therefor. A table top (11) having extension leaves (13, 14) secured to opposite edges (15, 16) of top (11) by hinges (17, 17A, 17B, and 17C). Hinge (17) including a pivot member (20), a slide member (21), a pivot pin (22) and an extension spring (23) operate to permit extension leaves (13, 14) to be oriented in three positions, horizontal and even with the table top (11), vertically upward, and vertically downward. When in the horizontal orientation, tongue (43) is engaged within channel (35). To reorient the extension leaves, tongue (43) is withdrawn from channel (35) against the spring (23) and may be pivoted on the pin (22).

7 Claims, 9 Drawing Figures

TABLE AND IMPROVED HINGE MECHANISM

Technical Field

The present invention relates generally to tables having folding or "drop" leaves and in particular to an improved hinge mechanism for use in connection therewith.

Background of the Prior Art

Tables and table services having folding or "drop" leaves have long been known in the prior art. The most common of these prior art systems is the type having a simple hinge leaf arrangement which allows the leaf to be raised to a horizontal position flush with the table top to provide a useable table surface of the desired width. When the table is not in use the leaves can be "dropped" or lowered to a vertical position at the sides of the table below the surface thereof, to provide for more compact storage. A slide bar arrangement such as the one shown in U.S. Pat. No. 3,437,058 issued to Bue has been used to hold the leaves in their horizontal position.

One application of a table with leaves is in the hotel field where a small table placed on castors and having such leaves is of greater value as a room service table. These tables are used for carrying prepared meals from the kitchen to the hotel guest's room and are used as dining tables. Folding drop leaves are provided so that the room service table will be narrow enough to conveniently pass through doorways, halls and elevators, while still providing a conveniently large dining surface. Such a table is described in detail in the U.S. Patent cited above.

The present invention improves over the prior art by providing a folding leaf table having hinge means which permit the leaves to be placed in a perpendicular and upward orientation with respect to the table surface so as to provide "sidewalls" for the table top which would help contain the articles placed on the table surface. In the case of a room service table, where the table is mobile, having the leaves in such an orientation helps prevent the prepared food from falling off the sides of the table as it was wheeled down the corridors of a hotel. Further, tables according to the present invention have guard means located on the undersides of the leaves so that when the leaves are in the above-described orientation, the guards will serve to protect walls and corners of the hotel corridors from damage when the table accidentally brushes against them.

BRIEF SUMMARY OF THE INVENTION

According to one aspect of the present invention, there is provided a table including a wheeled support, a table top, an extension leaf for the table top, and means hingeing the leaf to the table top for movement from a first position aligned with the table to second and third positions oppositely orthogonal to the top, including means operable to maintain the leaf in each of the first and second positions.

According to another aspect of the present invention, there is provided a locking hinge for enabling pivotal movement of a table leaf with respect to a table top from a first position, aligned with the table top, to second and third positions oppositely orthogonal to the table top, and for locking the leaf in each of the first and second positions. The locking hinge includes the combination of a pivot member having a mounting surface for securement below a table top near an edge thereof so that the pivot member extends in part beyond the edge, a slide member having a mounting surface for securement below a leaf to be hinged to the table top along the edge, so as to extend beyond an edge of the leaf toward the pivot member, a resilient means urging the slide member toward the pivot member, the pivot means including a pivot pin having an axis for alignment with the edge of the table top below the mounting surface, and having depending walls and a cross member extending therebetween to define a channel extending orthogonally to the mounting surface, and the slide member comprising an elongated tongue adapted to be slidably received in the channel, and including an elongated slot for traversal by the pin.

Various advantages and features of novelty which characterize the invention are pointed out with particularity in the claims annexed hereto and forming a part hereof. However, for a better understanding of the invention, its advantages, and objects attained by its use, reference should be made to the drawings which form a further part hereof and to the accompanying descriptive matter, in which are illustrated and described certain preferred embodiments of the invention.

DESCRIPTION OF THE PREFERRED EMBODIMENT

Figure 1:
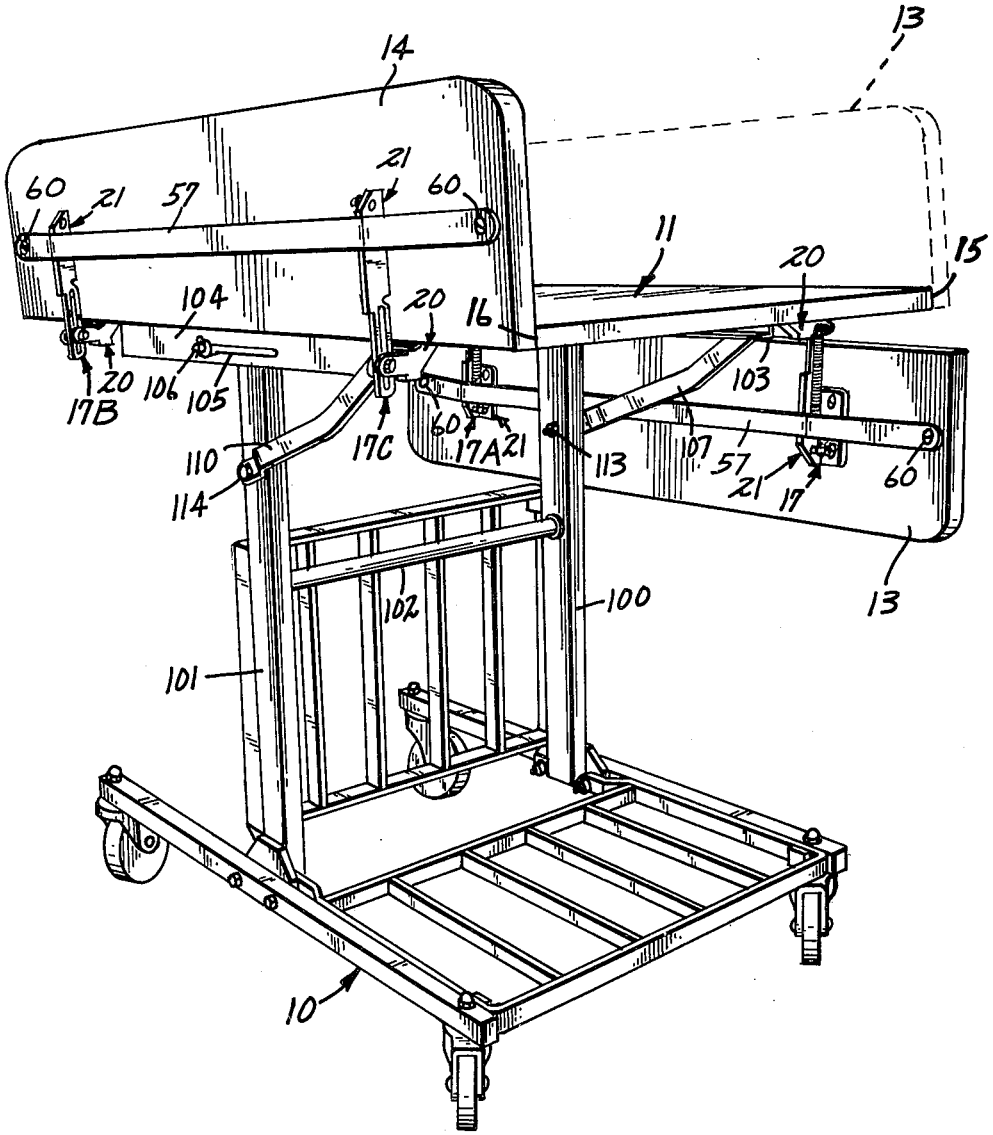
FIG. 1 is a view in perspective of a room service table incorporating the present invention.

A table according to the invention as shown in perspective in FIG. 1 comprises a wheel support 10, a table top 11 tiltably secured to support 10 by a suitable mechanism and a pair of extension leaves 13 and 14 secured to the opposite edges 15 and 16 of top 11 by locking hinges 17, 17A, 17B, and 17C.

Figure 3:
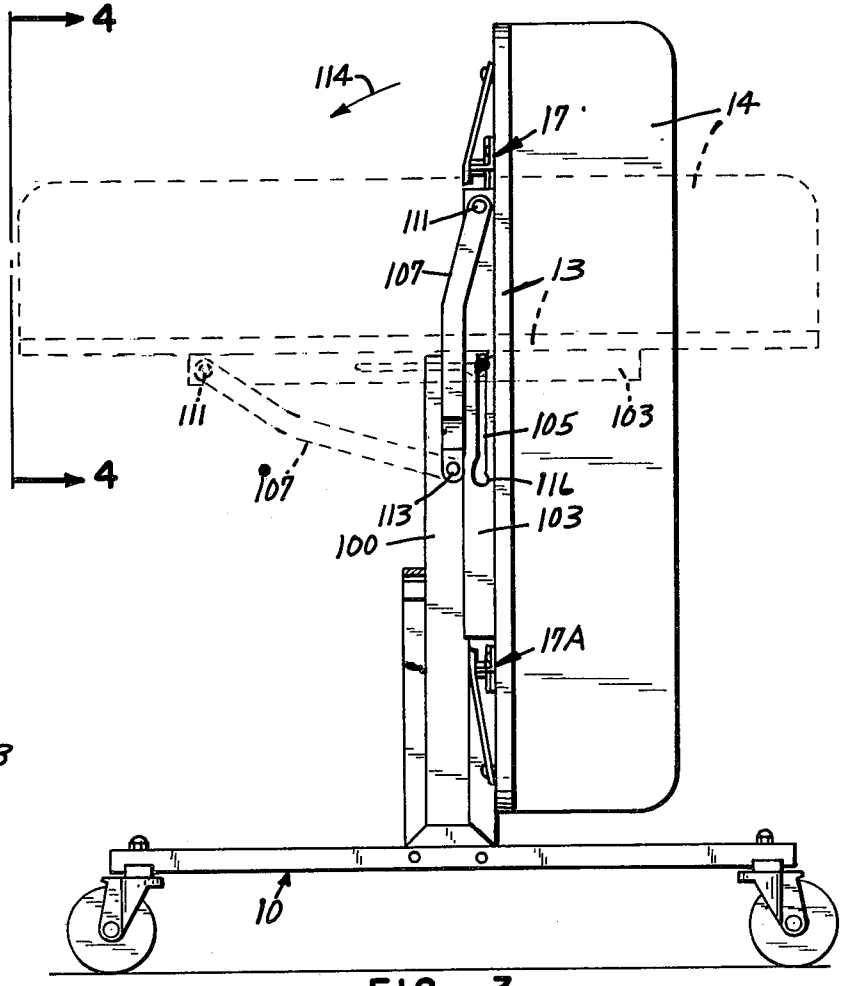
FIG. 3 is an elevational view of the same table as seen from right to left of FIG. 2, showing the storage position in solid lines and the use position in broken lines.
Figure 2:
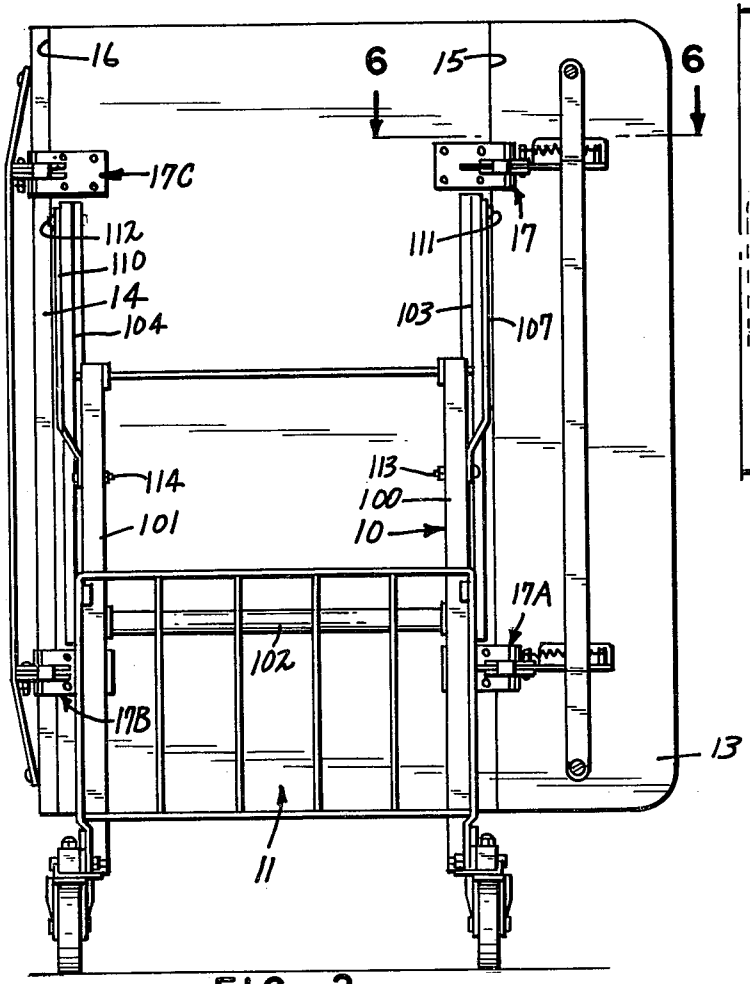
FIG. 2 is a view in elevation of a room service table incorporating the invention, with its top tilted into a storage position.

Support 10, as shown in greater detail in FIGS. 2–3, includes a pair of posts 100, 101 interconnected by a cross member 102. A pair of longitudinal rails 103 and 104 are secured below top 11 in any suitable fashion. A tilting mechanism of the type shown in U.S. Pat. No. 3,437,058 issued to Bue is used to permit movement of top 11 from a horizontal use position to a vertical storage position. Rails 103 and 104 are provided with shaped elongated slots 105. A rod 106 is secured at the tops of post 100 and 101 to extend laterally beyond and into slots 105. Arms 107 and 110 are pivoted to rails 103 and 104 at 111 and 112, and the posts 100 and 101 at 113 and 114, all respectively. The distance between pivots 111 and 113 is greater than the distance from pivot 113 to the upper end of slot 105 as seen in FIG. 3, so that when the table top is tilted in the direction of arrow 114, slots 105 move past rod 106, until the rod finally settles in a notch 116 at the end of the slot.

In the storage position of the parts shown in solid lines in FIG. 3, first ends of slots 105 rest on rod 106. When the parts are tilted in the direction of arrow 116, slots 105 slide on rod 106, until the rod finally seats in notches 116 at the second ends of the slots: the geometry of the mechanism prevents further tilting of the table from the horizontal use position shown in broken lines in FIG. 3. For resetting the table to its storage position the top is slightly lifted, to enable movement of rod 106 out of notches 116.

Figure 5:
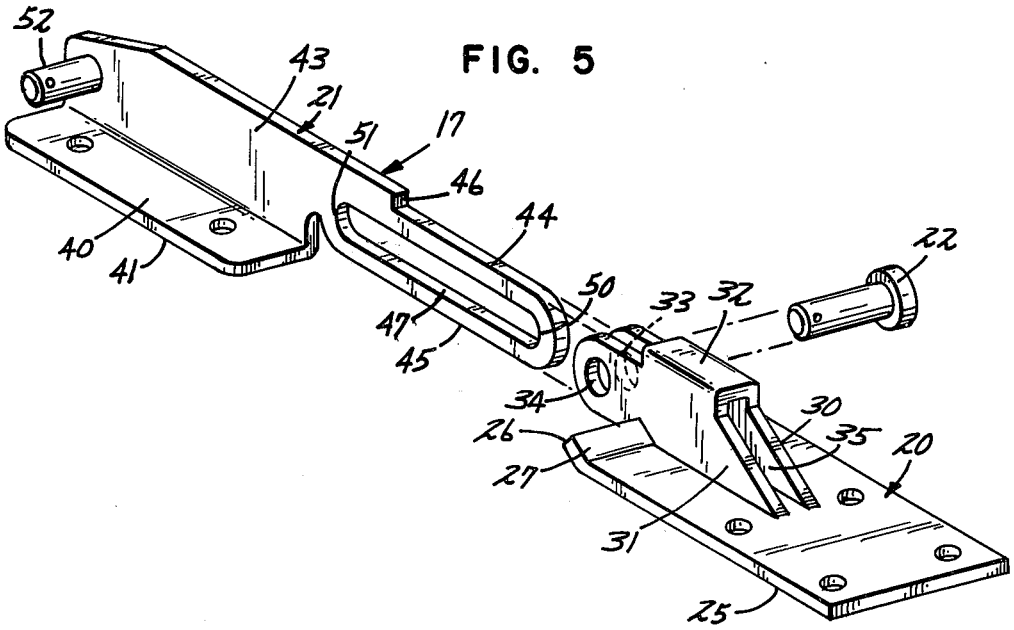
FIG. 5 is an exploded perspective view of some of the parts making up a locking hinge according to the invention.
Figure 6:
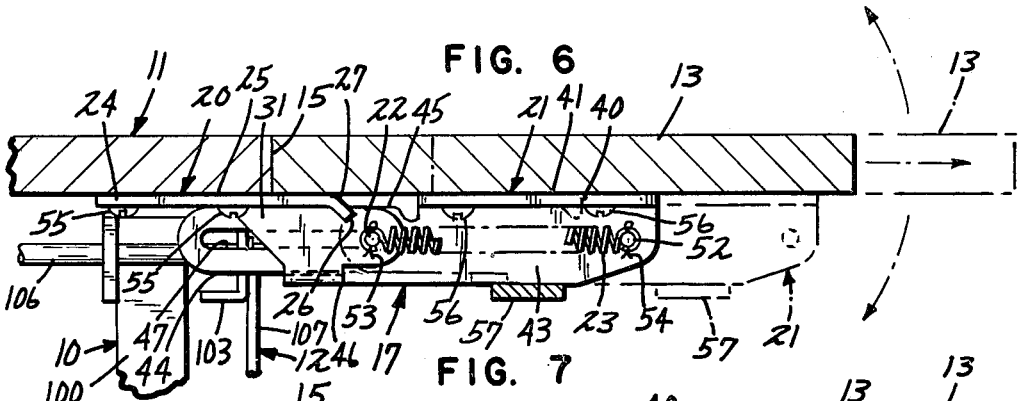
FIG. 6 is a sectional view as seen from the lines 6-6 of FIG. 2, to a larger scale, showing the parts in a first position.
Figure 7:
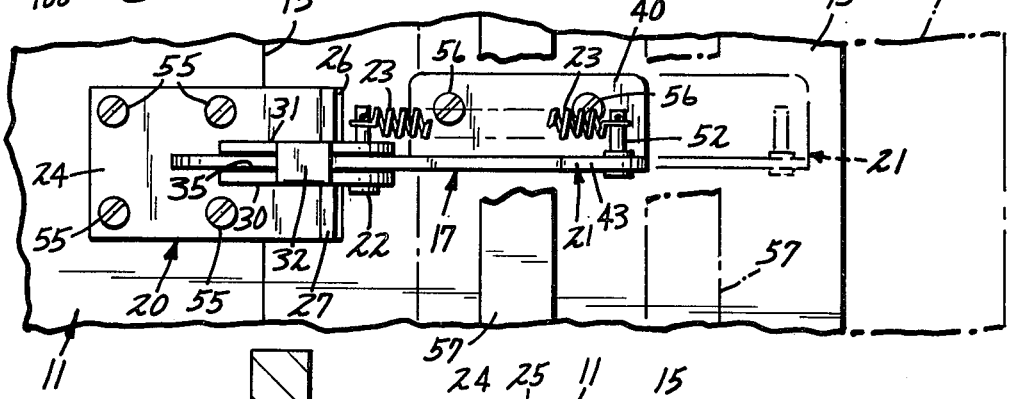
FIG. 7 is a bottom view of the structure of FIG. 6.

Extension leaves 13 and 14 are attached to table top 11 by four identical locking hinges 17, 17A, 17B, 17C. The details of hinge 17 are shown in FIGS. 5–7. Hinge 17 comprises a pivot member 20, a slide member 21, a pivot pin 22, and an extension spring 23. Member 20 includes a plate 24 having a flat mounting surface 25. The outer edge 26 of member 20 is turned away from surface 25 as a beveled lip 27.

A pair of laterally spaced walls 30 and 31 extend transversely away from mounting surface 25, and are joined at a site spaced from the mounting plate by a cross member 32. Walls 30 and 31 extend longitudinally beyond lip 27, and are provided with aligned holes 33, 34 to receive pivot pin 22. Plate 24, walls 30 and 31, and cross member 32 define a longitudinal channel 35, of known transverse dimensions extending parallel and orthogonal to the mounting surface.

Slide member 21 comprises a mounting plate 40 having a mounting surface 41. A tongue 43 extends transversely away from mounting surface 41, and extends longitudinally beyond plate 40. Tongue 43 has working edges 44 and 45, and is provided with a stop shoulder 46 and a longitudinal slot 47 extending between closed ends 50 and 51, for traversal by pin 22. A further pin 52 extends from tongue 43 at a site remote from slot 47, and spring 23 engages pins 22 and 52 at its ends, to draw members 20 and 21 toward one another, the assembly being secured by cotter pins 53 and 54.

A spaced pair of hinges 17 as shown in detail in FIGS. 5–8 are installed at each edge of the table, with pins 22 parallel to the edge and channels 35 perpendicular thereto. Mounting plate 24 is secured under the table top by fasteners 55, in such a position that surface 25 and lip 27 project beyond the edges 15 and 16. Member 21 is secured under the extension leaf by fasteners 56 so that when the edges of the top and leaf are in abutment tongue 43 is received in channel 35 with shoulder 46 engaging cross member 32 and pin 22 passing through hole 33, slot 47, and hole 34. If the table top and leaf are of the same thickness, surfaces 25 and 41 are coplanar. Spring 23 is secured at the ends to pins 22 and 52, and cotter pins 53 and 54 are inserted.

As best shown in FIGS. 1 and 2, a rub rail 57 is secured to the under surface of each leaf by fasteners 60, being formed to pass over the pair of hinges 17, 17A or 17B, 17C for each leaf. These rub rails, which may be constructed from straps of steel or other protective material, function as guards for protecting both the hinges and any walls or other objects which might be contacted by the table in motion.

Operation

In the arrangement of parts shown in FIGS. 6 and 7 and at the right of FIG. 2, leaf 13 is resiliently urged into edge-to-edge contact with top 11 by springs 23, and pivotal movement of the leaf about pivot pins 22 is prevented by contact of tongue edges 44 with plates 24 and tongue edges 45 with cross members 32.

Figure 9:
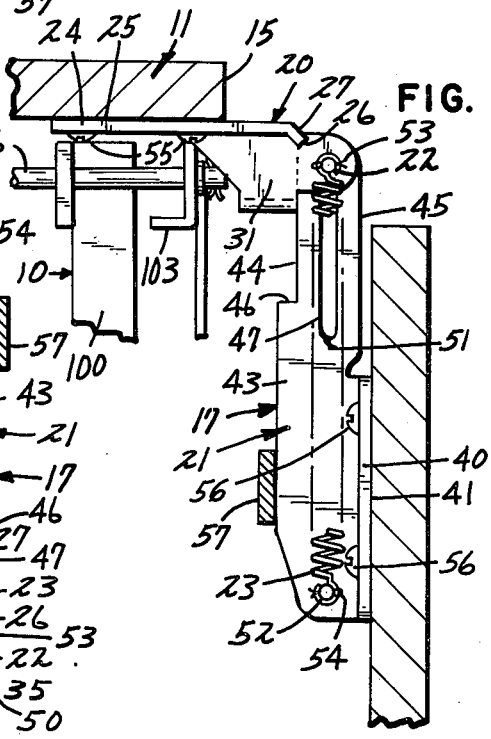

If it is desired to drop leaf 13, the leaf is drawn to the right, extending spring 23, until pin 22 engages the end 50 of slot 47. Tongue surfaces 44 and 45 are now clear of channel 35 and the leaf is enabled to pivot downwardly to the position shown in FIG. 9. Springs 23 need not be strong enough to support the weight of the leaf, which can simply hang on pins 22. Restoration of leaf 13 to its extended position is accomplished simply by pivoting the leaf upwardly, until tongues 43 can enter channels 35, the operation then being completed with the assistance of springs 32, and the leaf being guided into position by engagement of lips 27 with the undersurface of the leaf.

Figure 4:
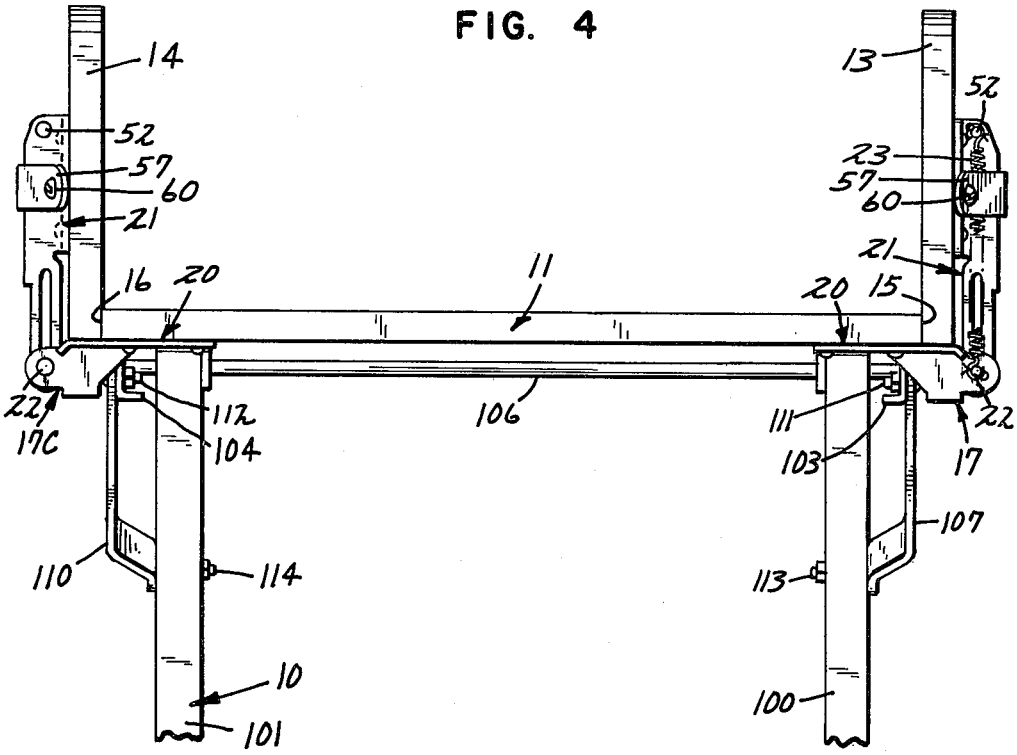
FIG. 4 is a fragmentary view as seen generally from the lines 4-4 of FIG. 3, with the top tilted to the use position.
Figure 8:
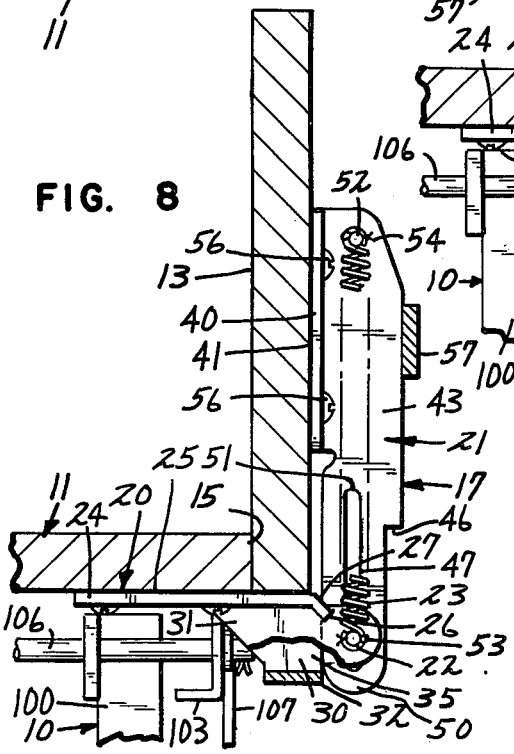
FIGS. 8 and 9 are views like FIG. 6 showing the parts in other positions.

When it is desired to move leaf 13 into the "side rail" position shown in FIG. 8, the leaf is first drawn outwardly as directed above to release tongues 43 from channels 35, then pivoted upwardly to the desired position, and then allowed to settle until its edge contacts the projecting portions of plates 24. Here the force of springs 23 is acting to hold the leaf against plate 24. Ends 50 of tongues 43 are now lower than plates 24 and cross members 32, so that edges 44 of the tongues prevent movement of the leaf about pins 22 in either direction. This position of leaf 14 is shown at the left in FIGS. 1 and 2, and both leaves are in this position in FIG. 4. FIG. 1 also illustrates leaf 13 in phantom lines in the upward position. It is clear that rub rails 35 are the most lateral portions of the table, and prevent contact of hinges 17 with walls, doorframes, and other surfaces past which the table is being moved. To remove the leaf from this position, it is lifted slightly until surface 44 disengages cross member 32, and may then be pivoted into any other desired position.

It should be understood that the present invention may be suitable for use in connection with any table-like surface where drop-leaves are desirable. Of particular interest is its use in connection with Room Service tables used in hotels for delivery of food to hotel rooms.

One of the requisites for room service tables is that they occupy minimum space when not in use: for this purpose table 11 is arranged to tilt into a vertical storage position. FIGS. 2 and 3 show that top 11 can be tilted into the storage position regardless of the positions of leaves 13 and 14, although the relative position of FIG. 3 is that in which the least storage space for the table is required. In addition, as a room service table, the ability to fold the leaves upwardly, as in FIG. 3, is of significant aid in maintaining plates on the table when the table is rapidly wheeled down hotel corridors. The rub rails 57 further aid in protecting the corridor walls from sustaining extensive damage of the type which would otherwise be caused by scraping of the hinges along the wall when wheeled down a corridor.

Numerous characteristics and advantages of the invention have been set forth in the foregoing description, together with details of the structure and function of the invention; the novel features thereof are pointed out in the appended claims. The disclosure, however, is illustrative only, and changes may be made in detail, especially in matters of shape, size, and arrangement of parts, within the principle of the invention, to the full extent intended by the broad general meaning of the terms in which the appended claims are expressed.

What is claimed is:

1. In a table, in combination:

a wheeled support;

a table top;

an extensive leaf for said table top;

and means hinging said leaf to said table top for movement from a first position aligned with said top to second and third positions oppositely orthogonal to said top, including means operable to maintain said leaf in each of first and second positions, said means comprising a pivot member including a pivot pin and a channel orthogonal thereto, and a slide member including a tongue sliding in said channel and slotted to enable passage of said pivot therealong.

2. A table according to claim 1 in which said tongue includes a stop shoulder for engaging an end to said channel and working edges for engaging said pivot member to prevent pivotal movement of said leaf about said pivot pin in predetermined relative positions of said top and said leaf.

3. A table according to claim 2 including means affixed to the underside of said leaf for preventing contact between said hinge means and a wall against which said table may come in contact.

4. A table according to claim 3 wherein said preventing means includes a protective rail extending over said hinge means.

5. A locking hinge comprising a pivot member having a first mounting surface and a slide member having a second mounting surface;

said pivot member including a pair of laterally spaced walls extending transversely away from said first mounting surface and a cross member joining said walls, at a site remote from said surface, to define a channel, of known transverse dimensions extending parallel and orthogonal to said surface, said walls extending longitudinally beyond said surface and supporting a cross pin axially parallel to said surface and orthogonal to the center line of said channel, and said slide member including an elongated tongue extending transversely away from said second mounting surface and longitudinally beyond said surface, and dimensioned to slide longitudinally in said channel, said tongue having an elongated slot extending parallel to said surface between first and second closed ends from a site near one end thereof, and crossed by said pivot pin of said pivot member, so that when said pin is adjacent said first end of said slot, said slide member is free to pivot about said pin from a first position, in which said mounting surfaces are aligned, to second and third positions, in which said second mounting surface extends perpendicularly to said first mounting surface in respectively opposite directions, said tongue being free to slide in said channel in said first position of said members, and engaging said cross member in said second position of said members to prevent pivotal movement of said slide member towards the position of alignment of said mounting surfaces.

6. A locking hinge comprising a pivot member having a first mounting surface, a slide member having a second mounting surface, and resilient means acting between said pivot member and said slide member;

said pivot member including a pair of laterally spaced walls extending transversely away from said first mounting surface and a cross member joining said walls, at a site remote from said surface, to define a channel, of known transverse dimensions extending parallel and orthogonal to said surface, said walls extending longitudinally beyond said surface and supporting a cross pin axially parallel to said surface and orthogonal to the center line of said channel, and said slide member including an elongated tongue extending transversely away from said second mounting surface and longitudinally beyond said surface, and dimensioned to slide longitudinally in said channel, said tongue having an elongated slot extending parallel to said surface between first and second closed ends from a site near one end thereof, and crossed by said pivot pin of said pivot member, so that when said pin is adjacent said first end of said slot, said slide member is free to pivot about said pin from a first position, in which said mounting surfaces are aligned, to second and third positions, in which said mounting surface extends perpendicularly to said first mounting surface in respectively opposite directions, said tongue being free to slide in said channel in said first position of said members, and engaging said cross member in said second position of said members to prevent pivotal movement of said slide member towards the position of alignment of said mounting surfaces.

7. A locking hinge for enabling pivotal movement of a table leaf with respect to a table top from a first position, aligned with said top, to second and third positions oppositely orthogonal to said top, and for locking said leaf in each of said first and second positions, comprising, in combination:

a pivot member having a mounting surface for securement below a table top near an edge thereof so that said member extends in part beyond said edge, said pivot member including a pivot pin having an axis for alignment with said edge of said table top below said mounting surface, and having depending walls and a cross member extending therebetween to define a channel extending orthogonally to said mounting surface;

a slide member having a mounting surface for securement below a leaf to be hinged to said table top along said edge, and a portion extending beyond an edge of said leaf toward said pivot member, said extended portion comprising an elongated tongue adapted to be slidingly received in said channel, said tongue including an elongated slot for transversal by said pivot pin to provide a hinge point between said table top and said table leaf; and resilient means urging said slide member toward said pivot member.

* * * * *